United States Patent [19]

Kobayashi et al.

[11] Patent Number: 4,474,456

[45] Date of Patent: Oct. 2, 1984

[54] DEVICE FOR HEAT-FIXING A TONER IMAGE

[75] Inventors: Yuichi Kobayashi, Yokohama; Ichiro Tsuruoka, Tokyo; Kenzo Ariyama, Yokohama, all of Japan

[73] Assignee: Ricoh Company, Ltd., Japan

[21] Appl. No.: 451,244

[22] Filed: Dec. 20, 1982

[30] Foreign Application Priority Data

Dec. 21, 1981 [JP] Japan ..... 56-205193

[51] Int. Cl.³ ..... G03G 15/20

[52] U.S. Cl. ..... 355/14 FU; 355/3 FU; 219/216; 219/388

[58] Field of Search ..... 355/14 FU, 3 FU; 219/216, 388, 395, 412, 425, 482, 483, 508

[56] References Cited

U.S. PATENT DOCUMENTS 4,059,394 11/1977 Ariyama et al. ..... 355/3 FU
4,315,136 2/1982 Block et al. ..... 355/3 FU
4,434,353 2/1984 Marsh et al. ..... 355/3 FU

*Primary Examiner*—Richard L. Moses
*Attorney, Agent, or Firm*—Guy W. Shoup

[57] ABSTRACT

A heat-fixing device includes a heat plate along which a transfer medium bearing thereon a toner image is advanced during which the toner image becomes fixed to the transfer medium by fusing, the heat plate including a plurality of heating sections arranged along the direction of advancement of said transfer medium each of the heating sections being provided with at least one electrical heater. The device also includes a control circuit for controlling the operation of the heaters such that, under a non-steady-condition, only selected ones of the heaters are set in operation thereby only the corresponding heating sections are positively heated; whereas, under a steady-state condition, all of the heaters are operated at the same time thereby maintaining all of the heating sections at a predetermined temperature.

20 Claims, 15 Drawing Figures

DEVICE FOR HEAT-FIXING A TONER IMAGE

BACKGROUND OF THE INVENTION

1. Field of the Invention

This invention generally relates to a fixing device for fixing a developed toner image to its underlying support medium with the application of heat, and, in particular, to a heat-fixing device which is suitable for use in an electrophotographic copying machine. More specifically, the present invention relates to a heat-fixing device including a heat plate along which a transfer medium bearing thereon a transferred toner image is transported whereby the toner image becomes fixed to the transfer medium by fusing.

2. Description of the Prior Art

In a typical electrophotographic copying machine of the wet-development type, a liquid developer comprised of carrier liquid and charged color particles, or commonly called toner particles which are dispersed in the carrier liquid is supplied to the surface of a photosensitive member on which an electrostatic latent image is formed, so that the toner particles are selectively attracted to the photosensitive member thereby the latent image is developed and a visible toner image is formed. Then a transfer medium, which is usually plain paper, is brought into contact with the photosensitive member and the toner image is transferred to the transfer medium as it is peeled off the member. Thereafter heat is added to the transfer medium now bearing thereon the transferred toner image so that the carrier liquid impregnated into the transfer medium evaporates and the toner particles are fused to become fixed to the transfer medium.

Stated more in detail with respect to a fixing process of a toner image, the transfer medium bearing thereon the transferred toner image on its front surface is transported in contact with and along a heat plate which is heated to a predetermined temperature, e.g., 200° C., by means of a heater provided in the heat plate. Thus, as the transfer medium moves along the heat plate, it becomes heated by receiving heat from the heat plate through its back surface and therefore the carrier liquid absorbed in the transfer medium evaporates and the toner particles are fused to become fixed to the transfer medium. However, a wait time period is usually required for the heat plate to reach a steady-state condition after power-up of the copying machine. Particularly, when the power switch of the copying machine is turned on after a long resting period, e.g., overnight, it often takes nearly two minutes for the heat plate to become heated to a predetermined temperature, which can be a cause for impairing practicality and usefulness of the copying machine.

It is true that even if the temperature of the heat plate is lower and the transfer medium having thereon a transferred toner image which is not completely fixed is discharged to a tray, the toner image may become completely fixed by natural evaporation of the carrier liquid. However, in this case, abrasion of the transfer medium would cause disturbance or removal of the toner particles. Moreover, since the toner particles are fixed to the transfer medium without being fused, the resulting image is low in quality, e.g., non-uniform in density.

From the power capacity of the copying machine, there is a limit in the amount of power which may be supplied to the fixing device so that there is a ceiling for the amount of electric power which may be applied to the heat plate. To cope with this situation, the thermal capacity of the heat plate may be made smaller thereby providing an increased speed for the heat plate to arrive at a predetermined temperature. In this case, however, if a number of transfer mediums are transported across the heat plate one after another continuously, the fixing performance of the heat plate will fluctuate to produce fixed images of poor quality because of thermal unstability caused by a reduction in thermal capacity. Accordingly it is not advantageous to reduce the thermal capacity of the heat plate because it will create unstability in performance under the steady-state condition.

SUMMARY OF THE INVENTION

In accordance with the present invention, there is provided a fixing device for heat-fixing a toner image to a transfer medium carrying thereon the toner image by causing the transfer medium to advance across and in contact with heating means including a plurality of heating sections arranged in the direction of advancement of transfer medium spaced apart from each other whereby the heating sections are selectively heated if the temperature of the heating means is below a predetermined level when the heating means is set in operation. With such a structure, the selected heating sections can reach a predetermined temperature rapidly so that the wait time may be cut down substantially and a fixed image of excellent quality may be obtained right from the beginning. The present invention has been developed based on the following recognition.

(1) In a copying machine, the amount of electric power which may be supplied to the fixing device is limited by the power source requirements of the copying machine. In most cases, the copying machine is hooked up to the commercial power line to receive electric power for operation. In this case, the amount of power applied exclusively to the fixing device is rather limited and in the order of 800 W.

(2) In an electrophotographic copying machine of the wet-development type, in order to substantially complete the fixing process while the transfer medium moves past the fixing device, a sufficient amount of thermal energy must be applied to the transfer medium to remove the carrier liquid impregnated into the transfer medium by evaporation.

(3) When use is made of fusible toner particles, an enhanced image quality may be obtained by heating the transfer medium above the fusing temperature of the toner particles by means of the fixing device.

(4) In a heat conduction phenomenon, the larger the temperature difference between two points, the larger the thermal energy transmitted therebetween, and, therefore, a subject to be heated can increase its temperature rapidly.

(5) With a fixed amount of heat applied to the heat plate of the fixing device, the smaller the thermal capacity of the entire heat plate, the faster the temperature increasing speed of the plate.

(6) While the fixing device is in the steady-state condition, the surface area of the heat plate contactable with the transfer medium must be made as large as possible in order to secure a stable fixing performance. For this reason, there is a limit in reducing the thermal capacity of the heat plate.

The present invention provides a novel fixing device which can satisfy all of the above-described requirements. Stated briefly, a plurality of heating sections are disposed in the direction of advancement of transfer medium spaced apart from each other and the heating sections are operated differently according to the mode of operation of the fixing device. That is, when the fixing device is in the non-steady-state condition, for example power-up condition, power is only applied to the selected heating sections; on the other hand, during the steady-state condition, power is applied to all of the heating sections.

It is therefore a primary object of the present invention to provide an improved device for fixing a toner image to its supporting structure such as transfer paper.

Another object of the present invention is to provide a heat-fixing device for fixing a toner image to a transfer medium on which the toner image rests by application of heat.

A further object of the present invention is to provide a heat-fixing device for fixing a toner image to its supporting structure which may be advantageously incorporated into an electrophotographic copying machine.

A still further object of the present invention is to provide a heat-fixing device which may be quickly made available for operation after power-up and yet which is capable of providing stable fixing performance even in an continuous mode of operation.

A still further object of the present invention is to provide an improved fixing device which is simple in structure and thus easy to manufacture.

Other objects, advantages and novel features of the present invention will become apparent from the following detailed description of the invention when considered in conjunction with the accompanying drawings.

DESCRIPTION OF THE PREFERRED EMBODIMENTS

Figure 1:
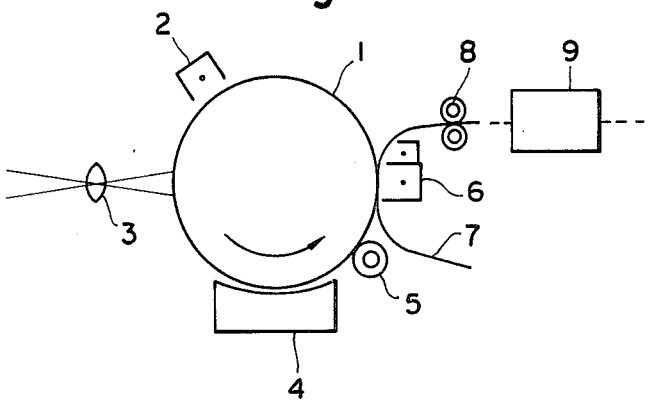
FIG. 1 is a schematic illustration showing the overall structure of an electrophotographic copying machine to which the present invention may be advantageously applied.

Referring now to FIG. 1, there is shown an electrophotographic copying machine including a photosensitive drum 1 which is supported to be rotatable by a machine housing (not shown) and driven to rotate in a predetermined direction as indicated by the arrow. As is well known in the art, the photosensitive drum 1 is comprised of a drum which is rotatably supported by the machine housing and a photosensitive member including an electrically conductive support formed on the peripheral surface of the drum and a photoconductive layer formed on the surface of the conductive support from Se or an alloy of Se and other materials.

In the vicinity of and along the peripheral surface of the photosensitive drum 1 are disposed such elements as a uniform charging device 2, an image exposing device 3, a wet-type developing device 4, a squeeze roller 5 and a transferring and separating device 6 in the order mentioned in the counterclockwise direction. Thus, as the drum 1 rotates in the direction indicated by the arrow at constant speed, the peripheral surface of the drum 1 is charged uniformly by the corona charger 2 and then the charges thus deposited are selectively removed by the image exposing device 3 to form an electrostatic latent image. As the drum 1 further rotates, a liquid developer is applied to the surface of the drum 1 from the wet-type developing device 4 so that the latent image is developed into a visible toner image. The toner image thus formed is defined by the toner particles attracted to the drum surface mainly due to electrostatic forces. After the development, the drum surface comes into contact with the squeeze roller 5 thereby the excessive liquid developer remaining on the drum surface is removed. Then the toner image is brought under the transferring and separating device 6 where a transfer medium 7 is supplied to be brought into contact with the drum surface where the toner image is present. The device 6 applies corona ions opposite in polarity from the toner particles to the back side of the transfer medium so that the toner particles are transferred to the front surface of the transfer medium 7. Thereafter, the transfer medium 7 carrying thereon the transferred toner image and impregnated with the carrier liquid is transported by a transport roller 8 toward a fixing device 9 where the toner image resting on the transfer medium 7 is firmly fixed to the medium 7.

Figure 2:
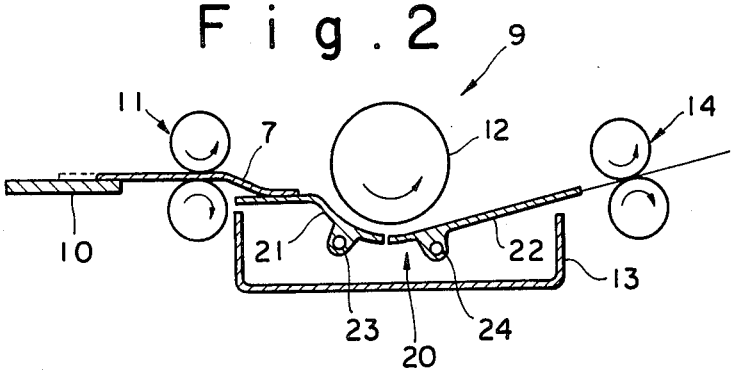
FIG. 2 is a schematic illustration showing the structure of the heat-fixing device constructed in accordance with one embodiment of the present invention.

As shown in FIG. 2, the fixing device 9 which is constructed in accordance with one embodiment of the present invention includes a pair of inlet rollers 11 disposed in the downstream of a transport table 10, a guide roller 12 disposed in the downstream of the inlet rollers 11, a heat plate 20 disposed below the guide roller 12 having a curved portion generally in compliance with the shape of the guide roller 12 thereby defining a transport path for the transfer medium 7, and a pair of outlet rollers 14 disposed in the downstream of the heat plate 20. The bottom surface of the heat plate 20 is enclosed by a case 13 which has a heat shielding function to prevent the heat radiated from the heat plate 20 from being transmitted to other elements of the machine.

The transfer medium 7 advancing along the table 10 comes into contact with the inlet rollers 11 and thus it is fed into the gap between the guide roller 12 and the heat plate 20 thereby the transfer medium 7 is guided along as pressed against the top surface of the heat plate 20. Therefore the transfer medium 7 slides along the top surface of the heat plate 20 toward downstream and finally it is transported to a tray (not shown) by the outlet rollers 14. While the transfer medium 7 is in contact with the heat plate 20, heat is transferred to the transfer medium 7 from the heat plate 20 so that the transfer medium 7 becomes heated beyond a predetermined temperature thereby the carrier liquid impregnated in the transfer medium 7 evaporates and the toner particles defining the toner image are fused to become heat-fixed to the transfer medium 7. Preferably, the peripheral surface of each of the inlet rollers 11, guide roller 12 and outlet rollers 14 is provided with a knurl so as not to disturb the toner image which is yet to be fixed and/or smear the surface of the transfer medium 7 when these rollers come into contact with the surface of the transfer medium 7.

Figure 3:
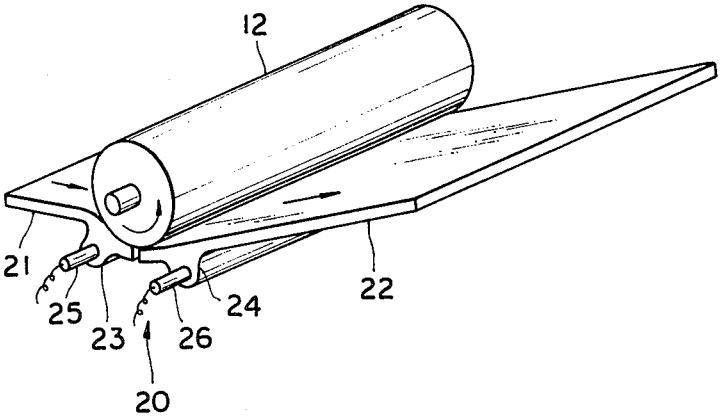
FIG. 3 is a perspective view showing on an enlarged scale the heat plate of the structure shown in FIG. 2.
Figure 4A:
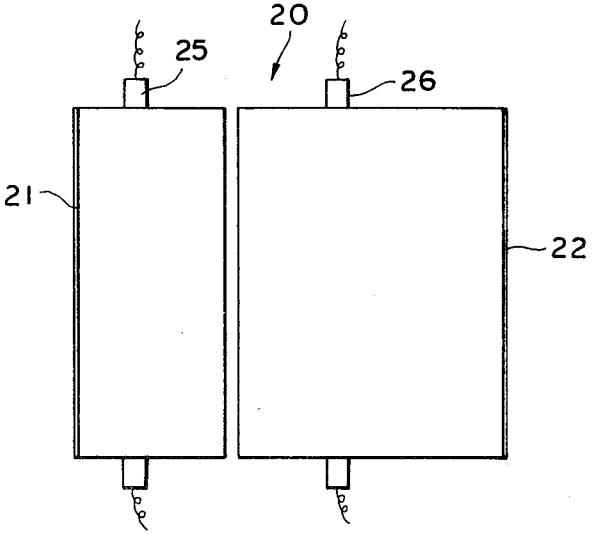
FIG. 4*a* is a plan view of the heat plate.
Figure 4B:
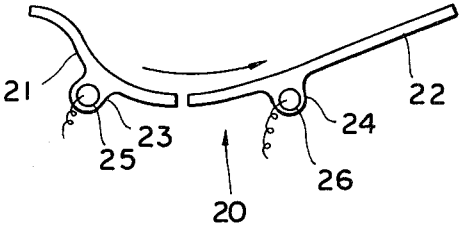
FIG. 4*b* is a front view of the heat plate.

Described in detail as to the structure of the heat plate 20 mainly with reference to FIGS. 3, 4*a* and 4*b*, it should first be noted that the heat plate 20 extending between the inlet and outlet rollers 11 and 14 in a defined shape is provided as separated into two sections: an upstream heat plate segment 21 and a downstream heat plate segment 22. The separation line between the two segments run perpendicularly to the advancing direction of the transfer medium 7. As shown, the downstream end portion of the upstream segment 21 is curved in compliance with the outer shape of the guide roller 12, and the upstream end portion of the downstream segment 22 is also slightly curved thereby defining a smooth transport path for the transfer medium 7. Each of the heat plate segments 21 and 22 is integrally provided with a heater mounting portion 23 or 24 extending across the width of the segment and projecting downwardly from the bottom surface of the segment generally below the guide roller 12. Each of the heater mounting portions 23 and 24 is provided with a through-hole in which is inserted a sheathed heater 25 or 26. Thus, when electric current is passed through either one or both of the sheathed heaters 25 and 26, one or both of the sheathed heaters produce heat which is transmitted to the heat plate segments to raise their temperatures. Although not shown specifically, a thermistor TM is provided to at least one of the heat plate segments, e.g., downstream segment 22, to detect the temperature of the heat plate 20.

Figure 5:
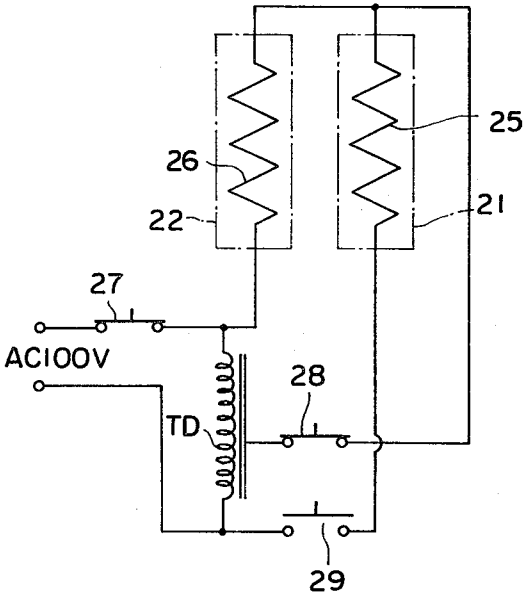
FIG. 5 is a schematic illustration showing the electrical arrangement of the fixing device of FIG. 2.

As a feature of the present invention, it is so structured that current may be passed through the sheathed heaters 25 and 26 selectively and thus the temperature of each of the segments 21 and 22 may be controlled independently from each other. FIG. 5 shows one example of the electrical connection to the sheathed heaters 25 and 26. As shown, the sheathed heaters 25 and 26 are connected in series to the commercial a.c. power line, e.g., 100 V, through switches 27 and 29, and the junction between the two sheathed heaters 25 and 26 is connected through a switch 28 to the intermediate tap of a transformer TD which is connected between the a.c. power source. It is to be noted that the switch 28 is a normally closed switch and the switch 29 is a normally open switch, and these two switches 28 and 29 are operated in association such that if one of them is open, then the other is closed. It is to be further noted that the position of the intermediate tap allows the sheathed heater 26 to receive an a.c. voltage of 70.7 V when the switch 28 is closed.

The associated operation of the switches 27, 28 and 29 is as follows:

(a) When the fixing device 9 is in the non-steady-state condition

If it is necessary to quickly raise the temperature of the heat plate 20 to a predetermined fixing temperature, e.g., 190°–200° C., as in the case when the power switch of a copying machine is turned on, the switches 27 and 28 are maintained to be closed. Under the circumstances, the switch 29 is maintained open in association with the closed state of the switch 28, so that an a.c. voltage of 70.7 V is only applied to the sheathed heater 26. As a result, only the sheathed heater 26 is activated to heat the downstream segment 22. On the other hand, the upstream segment 21 is left unheated or it is slightly heated by receiving radiant heat from the downstream segment 22.

(b) When the fixing device 9 is in the steady-state condition

In the case where the thermistor TM is provided in the downstream segment 22, when the temperature of the segment 22 detected by the thermistor goes beyond a predetermined level, e.g., 190°–200° C., the switch 28 is turned open and the switch 29 is closed in association therewith with the switch 27 left closed. Then an a.c. voltage of 100 V is applied to the serially connected sheathed heaters 25 and 26 so that each of the heaters receive an a.c. voltage of 50 V if the heaters have an identical resistance. Thus both of the heaters are activated and the two segments 21 and 22 are equally heated. Thereafter, the on/off operation of the switch 27 is controlled by the temperature detected by the thermistor and thus the heat plate segments 21 and 22 are maintained at a desired temperature suitable for the heat-fixing operation.

Figure 6:
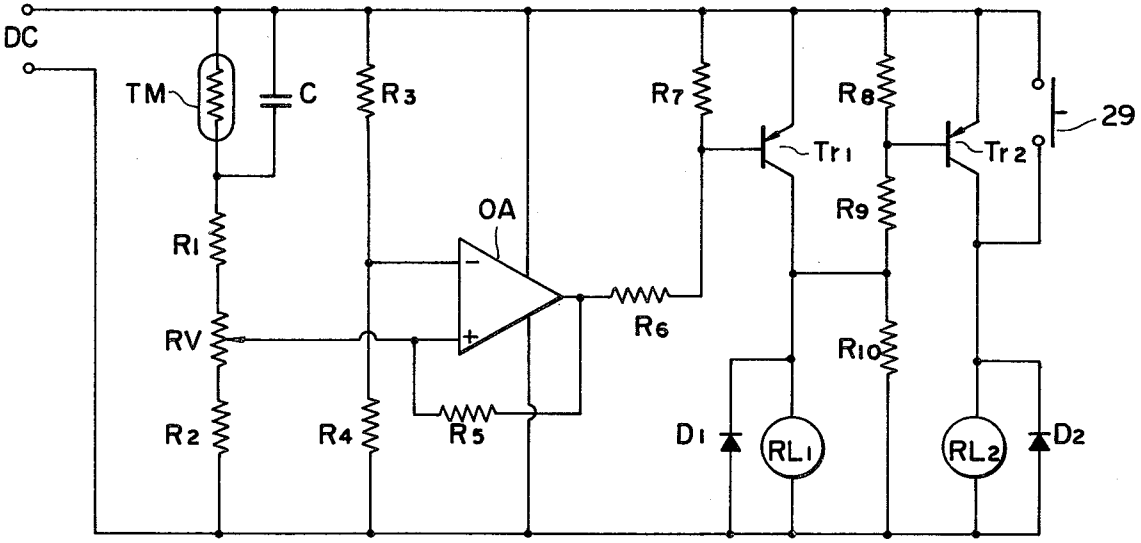
FIG. 6 is a circuit diagram of the control circuit for controlling the operation of the present fixing device.

FIG. 6 shows an example of a control circuit for controlling the operation of the above-mentioned switches in accordance with the temperature condition of the heat plate 20. As shown, the circuit includes the thermistor TM connected in series with resistors $R_1$, RV and $R_2$ between a d.c. power source and in parallel with a capacitor C. The tap of the resistor RV is connected to the non-inverting input of an operational amplifier OA whose inverting input is connected from the junction between resistors $R_3$ and $R_4$ to receive a regulated voltage determined by the voltage divider formed by these two resistors. The output of the op amp OA is connected through a resistor $R_6$ to the base of an PNP transistor Tr1, which is also connected to one terminal of the d.c. power source through a resistor $R_7$. The transistor Tr1 has its emitter connected to one terminal of the d.c. power source and its collector connected to the other terminal of the d.c. power source through a relay $RL_1$ which controls the on/off state of the switch 27. A diode $D_1$ is provided as connected in parallel with the relay $RL_1$ and with its cathode connected to the collector of the transistor Tr1. Furthermore, serially connected resistors $R_8$ and $R_9$ are provided as connected between the emitter and collector of the transistor Tr1 and another resistor $R_{10}$ is provided as connected in parallel with the relay $RL_1$. Also provided is a PNP transistor Tr2 having its emitter connected to one terminal of the d.c. power source, its base connected to the junction between the resistors $R_8$ and $R_9$ and its collector connected to the other terminal of the d.c. power source through another relay $RL_2$ which controls the on/off state of the switches 28 and 29. Another diode $D_2$ is provided as connected in parallel with the relay $RL_2$. Also shown is the switch 29 as coupled between the emitter and collector of the transistor Tr2.

In operation, if the downstream plate segment 22 is low in temperature and thus the resistance of the thermistor TM is relatively high, the op amp OA receives a low input at its non-inverting input so that the low level output signal is supplied to the base of the transistor Tr1 thereby it is rendered conductive and current flows through the relay $RL_1$ to close the switch 27. Under the condition, the transistor Tr2 is held non-conductive and thus the relay $RL_2$ is not energized. As a result, the switch 28 is closed and the switch 29 is open. Accordingly, the operating condition of the above-described non-steady-state condition is created and thus only the downstream plate segment 22 is positively heated.

When the temperature of the downstream segment 22 increases to go beyond a predetermined level and thus the resistance of the thermistor TM drops to supply a high input signal to the non-inverting input of the op amp OA, the high level output signal is supplied to the base of the transistor Tr1 from the op amp OA so that the transistor Tr1 is rendered non-conductive. Then the other transistor Tr2 is rendered conductive thereby causing the relay $RL_2$ energized, which, in turn, causes the switch 29 turned on and the switch 28 turned off. Accordingly, the above-described steady-state condition is created and current is supplied to both of the segments 21 and 22. It is to be noted that the relay $RL_2$ is of the self-holding type and thus once it is closed, it will hold the closed state irrespective of the output condition of the op amp OA. On the other hand, when the transistor Tr1 is turned off, the switch 27 which is operated by the relay $RL_1$ is turned open so that the supply of current to either one of the heaters 25 and 26 is discontinued; however, when the temperature detected by the thermistor TM goes below a predetermined level, the output signal from the op amp OA again changes to the low level so that the transistor Tr1 is again turned on to close the switch 27. Therefore, from now on, only the switch 27 is turned on or off depending upon the temperature detected by the thermistor TM and thus the heat plate segments 25 and 26 are maintained at a desired temperature for carrying out the heat-fixing operation.

With the above-described structure of one embodiment of the present fixing device, in bringing the heat plate 20 to a predetermined fixing temperature during the power-up period of a copying machine (non-steady-state condition), current is supplied only to the downstream segment 22 of the heat plate 20. In other words, under the non-steady-state condition, an a.c. voltage of 70.7 V is supplied only to the heater 26; whereas, under the steady-state condition, either of the heaters 25 and 26 receives an a.c. voltage of 50 V assuming that both of the heaters 25 and 26 have an identical resistance. In such circumstances, since power is proportional to square of voltage applied, the power supplied to the heater 26 under the non-steady-state condition is twice of that under the steady-state condition, though no difference in total power exists between the non-steady-state and steady-state conditions.

During the power-up period, since the thermal capacity of the heat plate 20 is reduced to that of the downstream segment 22, approximately half of that of the heat plate 20 in the illustrated example, the segment 22 may be heated to a desired temperature at a much faster rate. As an example, in the case where the heat plate 20 is made of foundry aluminum, its total weight is 225 grm and its specific heat is 0.225. Besides, each of the sheathed heaters 25 and 26 is comprised of a stainless steel pipe having the weight of 30 grm and the specific heat of 0.2, an insulating material of magnesium oxide having the weight of 26 grm and the specific heat of 0.25 and a Nichrome wire having the weight of 4 grm and the specific heat of 0.12. As a result, the total thermal capacity of the heat plate 20 as a whole including the sheathed heaters 25 and 26 is approximately 76.6 cal/g. Thus, the time required to raise the temperature of the heat plate 20 which is currently at 0° C. to 200° C. by applying the power of 800 W may be calculated as follows:

$$T=(76.6\times 200)/(800\times 0.24)=79.8 \text{ (seconds)}$$

where power-calorie conversion constant of 0.24 is used.

In the above-described embodiment, only the downstream segment 22 is positively heated during the power-up period, and thus the thermal capacity is approximately reduced into half, which then cuts the time required to increase the temperature of the heat plate 20 to a predetermined temperature of 200° C. approximately to half as compared with the case in which the heat plate 20 is not segmented. Such a reduced time period is comparable to the idling time period (typically 20–30 seconds) in which the photosensitive drum 1 is driven to rotate over a single turn upon closure of the power switch of the copying machine so as to carry out cleaning of the photosensitive surface. Under the circumstances, even if a reproduction process is initiated upon completion of the idling rotation of the photosensitive drum 1, the very first copy may be subjected to the heat-fixing operation with a required high temperature of 200° C. And thus the carrier liquid absorbed in the transfer medium may be evaporated substantially and the toner particles may be fused to become fixed to the transfer medium thereby allowing to obtain a high quality image. On the other hand, under the steady-state condition, the heaters 25 and 26 are operated in unison and the entire heat plate 20 is maintained at a predetermined temperature.

Figure 7:
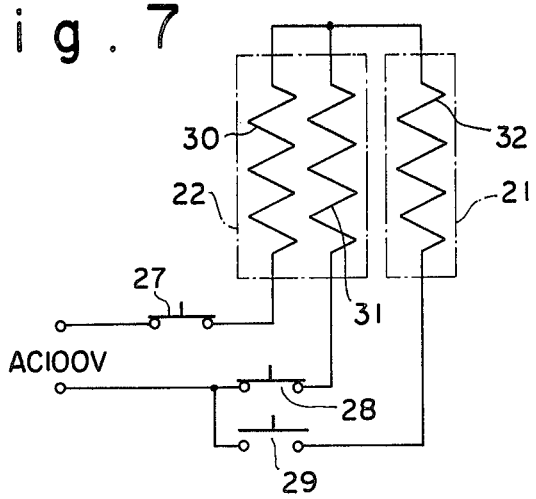
FIG. 7 is a schematic illustration showing the electrical arrangement of another embodiment of the present fixing device.

Referring now to FIG. 7, another embodiment of the present fixing device will be described hereinbelow. In this embodiment, three sheathed heaters 30, 31 and 32 of the identical resistance are used and the two heaters 30 and 31 are provided in the downstream segment 22 with the remaining heater 32 provided in the upstream segment 21. As shown, with respect to an a.c. voltage source, the heaters 30 and 31 are connected in series through the switches 27 and 28, and the heater 32 is connected in parallel with the heater 31 via the switch 29. Similarly with the above-described embodiment, when the switches 27 and 28 are closed, the heaters 30 and 31 are activated to heat the downstream segment 22; on the other hand, when the switch 28 is open and the switch 29 is closed, the heaters 30 and 32 are set in operation thereby both of the segments 21 and 22 are heated. Accordingly, the operation of this embodiment does not differ from that of the previous embodiment.

Figure 8:
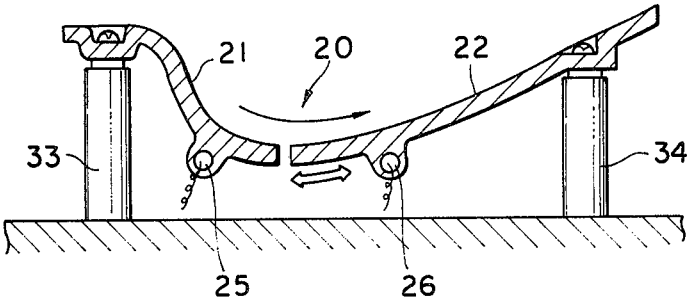
FIGS. 8 and 9 are schematic illustrations showing further embodiments of the present fixing device.

In turn, further embodiments of the present invention will be described with particular reference to FIGS. 8 and 9. These embodiments are directed to attain thermal stability of the heat plate 20 as a whole during the steady-state condition. In the embodiment shown in FIG. 8, the upstream and downstream plate segments 21 and 22 are fixedly mounted on posts 33 and 34, respectively, which, in turn, are fixedly mounted on a machine housing (not shown). Then the spacing between the two segments 21 and 22 is determined such that the opposed end faces of the segments 21 and 22 come into contact due to thermal expansion when the segments 21 and 22 are heated to a predetermined fixing temperature. With such a structure, the two segments 21 and 22 are separated from each other to insure a reduced thermal capacity under the non-steady-state condition; whereas, they are brought into contact during the steady-state condition so that heat may be transmitted from one to the other thereby allowing to obtain uniform temperature distribution across the entire surface of the heat plate 20, which, in turn, contributes to stabilize the heat-fixing operation.

Figure 9:
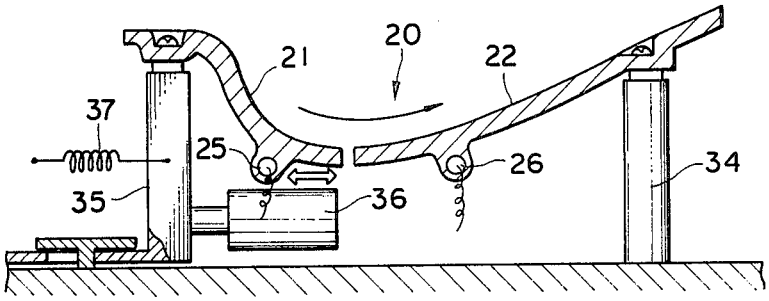

In the embodiment illustrated in FIG. 9, the upstream segment 21 is fixedly mounted on the post 35 which is movably supported on the machine housing (not shown) such that the upstream segment 21 is moved closer to or separated away from the downstream segment 22 which is fixedly mounted on the stationary post 34. A coil spring 37 is provided with its one end fixed to the machine housing and the other end fixed to the movable post 35 so that the upstream segment 21 is normally biased to move away from the downstream segment 22. Also provided on the machine housing is a solenoid 36 whose core is connected to the movable post 35. Thus during the non-steady-state condition, the solenoid 36 is left deenergized to keep the upstream segment 21 separated away from the downstream segment 22. On the other hand, once the steady-state condition is established, the solenoid 36 is energized and the upstream segment 21 is brought into contact with the downstream segment 22. Consequently, this embodiment allows to obtain the similar effects as in the case of the previous embodiment of FIG. 8.

Figure 10A:
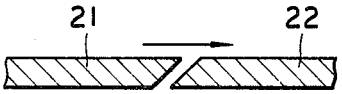
FIGS. 10*a*–10*c* are fragmentary, cross sectional views showing several examples of the joint structure between the two adjacent heat plate segments in accordance with the present invention.
Figure 10B:
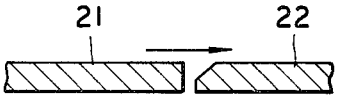
Figure 10C:
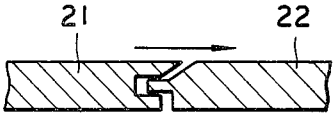

FIGS. 10*a*–10*c* show several embodiments for the joint structure between the upstream and downstream segments 21 and 22 in order to enhance smoothness in transporting the transfer medium 7 along the entire heat plate 20. In the embodiment of FIG. 10*a*, the opposed end faces of the segments 21 and 22 are inclined such that the transfer medium travels along the top surface is prevented from entering into the gap between the two end faces. That is, the end face of the upstream segment 21 is inclined such that it forms an acute angle with its top surface which defines a part of the travelling path for the transfer medium. In the embodiment of FIG. 10*b*, the top shoulder portion of the downstream segment 22 is cut off or rounded. Finally, in the embodiment shown in FIG. 10*c*, the opposed end faces are partly inclined similarly with the embodiment of FIG. 10*a* and a recess is formed in the center of the end face of the upstream segment 21 with the corresponding projection formed on the end face of the downstream segment 22. If the opposed end faces of the segments 21 and 22 are constructed in accordance with either one of the above-described examples, the leading edge of the transfer medium is prevented from being trapped in the gap between the segments 21 and 22. It is true, however, that provision of such modified structure is not by all means necessary because the gap between the segments may be set extremely small.

Figure 11:
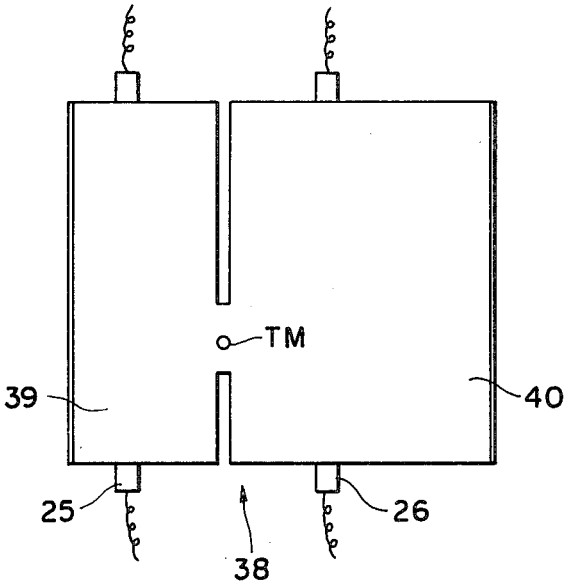
FIG. 11 is a plan view showing the heat plate constructed in accordance with another embodiment of the present invention.

FIG. 11 shows the heat plate 38 which is used in a still further embodiment of the present invention. The heat plate 38 shown includes an upstream segment 39 and a downstream segment 40 which is physically connected to the upstream segment 39 by a bridge section provided to bridge between the two segments 39 and 40. Stated another way, a pair of slits is formed in the heat plate 38 arranged along a straight line and spaced apart from each other at the position directly below the guide roller 12 (FIG. 2). And thus it may be said that the heat plate 38 is divided by the pair of slits into two heating sections: upstream heating section 39 and downstream heating section 40. As shown, the bridge section is rather narrow in width, the two heating sections 39 and 40 may be operated selectively as discussed in detail above. The thermistor TM may be provided in the bridge section in which case an average temperature between the two heating sections may be used to control the operation of the present device.

It is to be noted that provision of the slits may be omitted and the heat plate 38 may be used as a single unitary plate. Even in this case, that portion of the heat plate 38 in the vicinity of the heater 25 may be thought as the upstream heating section and similarly that portion of the heat plate 38 in the vicinity of the heater 26 may be thought as the downstream heating section, though these sections are not physically well defined in this embodiment. However, since the pair of heaters 25 and 26 are provided in the heat plate 38 spaced apart from each other and if they are selectively operated under control, the heat plate 38 may be locally heated to a desired level quickly during the non-steady mode and the similar effects as described above may be attained. It is to be further noted that any heat insulating material may be filled into the gap or slits of the heat plate as shown in FIG. 4*a* or 11 to make the top surface of the heat plate completely smooth.

It has been experimentally found that in the case where the heat plate is divided, either physically or conceptually, into two sections as described above, it is preferable to set the downstream section in operation during the non-steady-state mode rather than the upstream section in order to obtain a better fixing performance. It should however be noted that the present invention should not be limited as such, and alternatively the upstream section may be selected for operation during the non-steady-state condition. Furthermore, the number of the divided heating sections to be provided should not be limited to two as in the above-described embodiments and the number may be chosen to be three or more. Further, the present fixing device is not limited to the case of fixing the toner image formed by wet-type development as described above, and it is also applicable to the case where the toner image formed by dry-type development is to be fixed. Accordingly, the present invention may be equally applied to an electrophotographic copying machine of the dry-type development.

Figure 12:
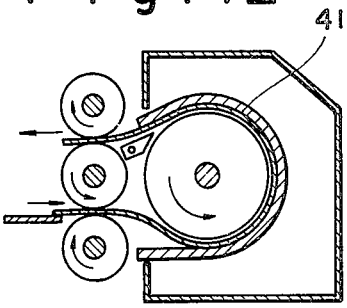
FIG. 12 is a schematic illustration showing a still further embodiment of the present fixing device.

While the above provides a full and complete disclosure of the preferred embodiments of the present invention, various modifications, alternate constructions and equivalents may be employed without departing from the true spirit and scope of the invention. For example, the present invention may also be applied to the heat plate 41 of the fixing device of FIG. 12 which plate is curved to substantially enclose the guide roller 12. Therefore, the above description and illustration should not be construed as limiting the scope of the invention, which is defined by the appended claims.

What is claimed is:

1. A device for fixing a toner image to its supporting medium comprising:

heating means having a portion defining a part of a transport path along which said supporting medium is advanced, said heating means including a plurality of heating sections for heating said supporting medium arranged in the direction of advancement of said supporting medium along said transport path and heat-producing means provided for each of said heating sections;

guiding means for guiding said supporting medium to advance along and at least partly in contact with said portion of said heating means; and control means for controlling the operation of said heat-producing means such that, under a non-steady-state condition, only selected ones of said heat-producing means are set in operation to raise the temperature of the corresponding heating sections rapidly to a predetermined level; whereas, under a steady-state condition, all of said heat-producing means are set in or out of operation at the same time to maintain the temperature of said heating sections at a predetermined level.

2. A device of claim 1 wherein said plurality of heating sections include an upstream heat plate segment and a downstream heat plate segment which are arranged spaced apart from each other along the direction of advancement of said supporting medium, each of said segment having its top surface defining a part of said transport path, and said heat-producing means includes at least one electrical heater integrally provided in each of said plate segments whereby said electrical heater produces heat to be applied to the corresponding plate segment when current is passed therethrough.

3. A device of claim 2 wherein said control means control the operation of said electrical heater of each of said plate segments such that, under the non-steady-state condition, current is supplied only to the electrical heater of said downstream heat plate segment thereby rapidly raising the temperature of said downstream heat plate segment to a predetermined level; whereas, under the steady-state condition, current is supplied to the electrical heater of each of the upstream and downstream heat plate segments.

4. A device of claim 2 wherein the gap between the opposed end faces of said upstream and downstream heat plate segments is determined such that they are brought into contact by thermal expansion when said upstream and downstream heat plate segments are heated to a predetermined level under the steady-state condition.

5. A device of claim 2 wherein at least one of said upstream and downstream heat plate segments is movably provided from each other and the opposed end faces of said upstream and downstream heat plate segments are brought into contact when said device is to be operated under the steady-state condition.

6. A device of claim 5 wherein at least one of said upstream and downstream heat plate segments is spring biased to move away from the other and a solenoid is provided to be operatively coupled to at least one of said segments to bring both of said segments in contact when said device is to be operated under the steady-state condition.

7. A device of claim 2 wherein the opposed end faces of said upstream and downstream heat plate segments are constructed so as not to interfere with smooth advancement of said supporting medium along the top surfaces of said segments.

8. A device of claim 7 wherein the end face of said upstream heat plate segment is inclined to form an acute angle with its top surface and the end face of said downstream heat plate segment is correspondingly inclined.

9. A device of claim 7 wherein the opposed end faces of said upstream and downstream heat plate segments are generally perpendicular to their top surfaces and the top shoulder portion of said end face of said downstream heat plate segment is cut-away or rounded.

10. A device of claim 7 wherein the end face of one of said upstream and downstream heat plate segments is provided with a recess and the end face of the other segment is provided with a projection slidably inserted in said recess.

11. A device of claim 2 further comprising a bridge section provided in a part of the gap between said upstream and downstream heat plate segments, said bridge section integrally connecting said upstream and downstream heat plate segments.

12. A device of claim 2 or 11 wherein a heat insulating material is filled into the gap between said upstream and downstream heat plate segments.

13. A device of claim 2 or 11 wherein said control means includes a temperature detector for detecting the temperature of a predetermined postion of said heat plate segments.

14. A device of claim 13 wherein said detector is a thermistor and it is provided in said bridge section.

15. A device of claim 1 wherein said guiding means includes a guide roller disposed above the transport path of said heating means and driven to rotate in a predetermined direction to move said supporting medium along and in contact with the heating sections of said heating means.

16. A device of claim 15 further comprising cover means for substantially enclosing the bottom of said heating means thereby shielding the transmission of heat in the downward direction.

17. A device of claim 15 further comprising a pair of inlet rollers disposed at the entrance of said device and a pair of outlet rollers disposed at the exit of said device.

18. A device of claim 1 wherein said supporting medium is a transfer medium and said toner image is an image transferred to said transfer medium from a photosensitive member on which said toner image is originally formed in accordance with an electrophotographic reproduction process.

19. A device of claim 18 wherein said toner image is formed by the wet-type development.

20. A device of claim 18 wherein said toner image is formed by the dry-type development.

* * * * *